US006679681B2

(12) United States Patent
Burnett et al.

(10) Patent No.: US 6,679,681 B2
(45) Date of Patent: Jan. 20, 2004

(54) FLUSH TENON COVER FOR STEAM TURBINE BLADES WITH ADVANCED SEALING

(75) Inventors: Mark Edward Burnett, Buskirk, NY (US); Daniel Randolph Trembley, Old Town, ME (US); Maurice David Fournier, Hermon, ME (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/119,291

(22) Filed: Apr. 10, 2002

(65) Prior Publication Data

US 2003/0194312 A1 Oct. 16, 2003

(51) Int. Cl.[7] ..... F01D 11/02

(52) U.S. Cl. ..... 415/173.5; 415/209 R; 416/191; 416/210 R

(58) Field of Search ..... 415/173.5, 173.6, 415/209 R, 210.1, 191, 196; 416/191, 192, 190, 210 R, 214 R, 222

(56) References Cited

U.S. PATENT DOCUMENTS

| | | | | |
|---|---|---|---|---|
| 3,897,169 A | * | 7/1975 | Fowler | 415/172 A |
| 5,261,785 A | | 11/1993 | Williams | |
| 5,271,712 A | * | 12/1993 | Brandon | 415/121.2 |
| 5,509,784 A | | 4/1996 | Caruso et al. | |
| 5,632,598 A | * | 5/1997 | Maier | 415/173.5 |
| 5,775,873 A | * | 7/1998 | Dalton et al. | 415/121.2 |
| 5,890,873 A | | 4/1999 | Willey | |
| 6,036,437 A | | 3/2000 | Wolfe et al. | |

* cited by examiner

*Primary Examiner*—Edward K. Look
*Assistant Examiner*—J. M. McAleenan
(74) *Attorney, Agent, or Firm*—Nixon & Vanderhye

(57) ABSTRACT

Steam turbine buckets have radially projecting tenons received in openings of covers. The covers are provided with a profiled surface, with recesses or radially outwardly projecting teeth, or both, to form a gap between the cover and a stationary component having increased pressure drop with resulting decreased leakage flow and reduced potential for solid particle erosion. In the profiled cover surface, the outer surface of the tenon and outer surface of the cover are machined to form the recesses or teeth, affording a flush cover/tenon design with improved sealing efficiencies and reduced solid particle erosion.

17 Claims, 3 Drawing Sheets

FLUSH TENON COVER FOR STEAM TURBINE BLADES WITH ADVANCED SEALING

BACKGROUND OF THE INVENTION

The present invention relates to steam turbines and more particularly to a steam turbine cover for minimizing or eliminating solid particle erosion of bucket tenons and to improve sealing efficiency.

In conventional steam turbines, bucket covers are typically attached to the buckets by peening the tenon projecting from the end of the bucket and through an aperture in the bucket cover. This peening operation results in a projecting bulb or knob on the outside diameter of the cover. This raised knob or projection can be eroded by solid particles in the steam path. As a result, the cover may become loose, crack or separate from the buckets. Also, the raised knob or projection, resulting from peening the tenon, substantially prevents the application of one or more labyrinth seal teeth along the outside face of the cover, particularly on units with large differential expansion between the stationary and rotating components.

In another cover-to-bucket design, the knob or projection of the peened tenon is disposed below the outer surface or outer diameter of the cover. While that configuration enabled the application of sealing teeth configurations to the cover, it is limited to straight tooth or flat surface geometry. Under certain conditions, solid particles may become trapped within the confines of the recess and between the walls defining the recess and the tenon. These trapped particles tend to erode the tenon knob or projection very quickly and have been shown, in certain circumstances, to essentially cut through the tenon.

Another bucket/cover design includes the integral formation of the bucket and cover. While this design incorporates the necessary sealing options, i.e., application of one or more labyrinth seal teeth, and also minimizes or eliminates the concern for solid particle erosion, the integral bucket/cover combination is costly to manufacture and complex. Accordingly, there has arisen a need for a bucket/tenon/cover design that both eliminates or minimizes solid particle erosion, as well as affords sealing efficiencies without complexity or excessive costs.

BRIEF DESCRIPTION OF THE INVENTION

In accordance with a preferred embodiment of the present invention, there is provided in a steam turbine, a plurality of buckets mounted on a rotating component, e.g., a rotor, and a plurality of covers mounted on the tips of the buckets, the buckets having tenons peened to secure the buckets to the covers. At least one recess is preferably formed in the outer cover surface to form a profiled surface and at least one tooth projects either radially outwardly from the profiled surface or radially inwardly from the registering stationary component. In a preferred embodiment hereof, the profiled surface includes at least one recess defined at least in part by the tenon. In another preferred embodiment, the profiled surface includes a tooth projecting from the outer surface of the cover toward the stationary component and including at least part of the tenon. It will be appreciated that the recess or the tooth each formed, at least in part, by the tenon extend in a circumferential direction about the cover. To form this preferred configuration, the outer surface of the cover is machined such that the tenon forms part of the recess or the labyrinth tooth, as applicable.

In a preferred embodiment according to the present invention, there is provided in a steam turbine having a plurality of buckets rotatable about an axis and a stationary component surrounding the buckets, a seal between the buckets and the stationary component, comprising a cover mounted on a radial outer end of at least one bucket and having an opening, one bucket having a tenon projecting from the outer end of one bucket and extending into the cover opening, an outer surface of the cover and an outer end surface of the tenon forming a profiled surface in opposition to the stationary component with contiguous surfaces of the tenon end and the cover lying flush with one another, the profiled surface including at least one of a recess formed in the profiled surface and a tooth projecting radially outwardly of the profiled surface.

In a further preferred embodiment according to the present invention, there is provided in a steam turbine having a plurality of buckets rotatable about an axis and a stationary component surrounding said buckets, a seal between the buckets and the stationary component, comprising a plurality of covers mounted on radial outer ends of the buckets arranged in an annular array thereof with one or more buckets being secured to each cover, each cover having at least one opening and each bucket having a tenon projecting from the outer end thereof into the opening, an outer surface of each cover and an outer end face of each tenon forming a profiled surface in opposition to the stationary component with contiguous surfaces of the tenon end faces and the outer cover surface lying flush with one another.

In a further preferred embodiment according to the present invention, there is provided in a steam turbine having a plurality of buckets rotatable about an axis and a stationary component surrounding the buckets, a seal between the buckets and the stationary component, comprising a plurality of covers mounted on radial outer ends of the buckets arranged in an annular array thereof with one or more buckets being secured to each cover, each cover having at least one opening and each bucket having a tenon projecting from the outer end thereof into the opening, an outer surface of each cover and an outer end face of each tenon forming a profiled surface in opposition to the stationary component with contiguous surfaces of the tenon end faces and the outer cover surface lying flush with one another, the profiled surface including at least one recess, the profiled surface including a tooth projecting radially outwardly thereof.

DETAILED DESCRIPTION OF THE INVENTION

Figure 2:
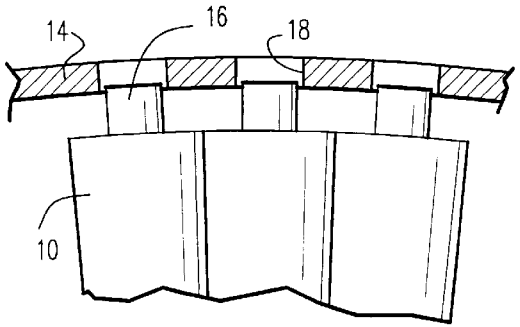
Fig.2 (PRIOR ART)
FIG. 2 is a fragmentary enlarged view illustrating the tenons and openings through the cover prior to assembly.
Figure 3:
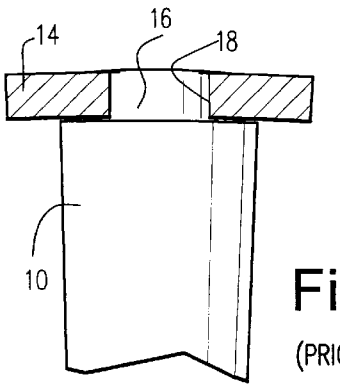
Fig.3 (PRIOR ART)
FIG. 3 is a fragmentary cross-sectional view illustrating a flush tenon cover/bucket connection.
Figure 1:
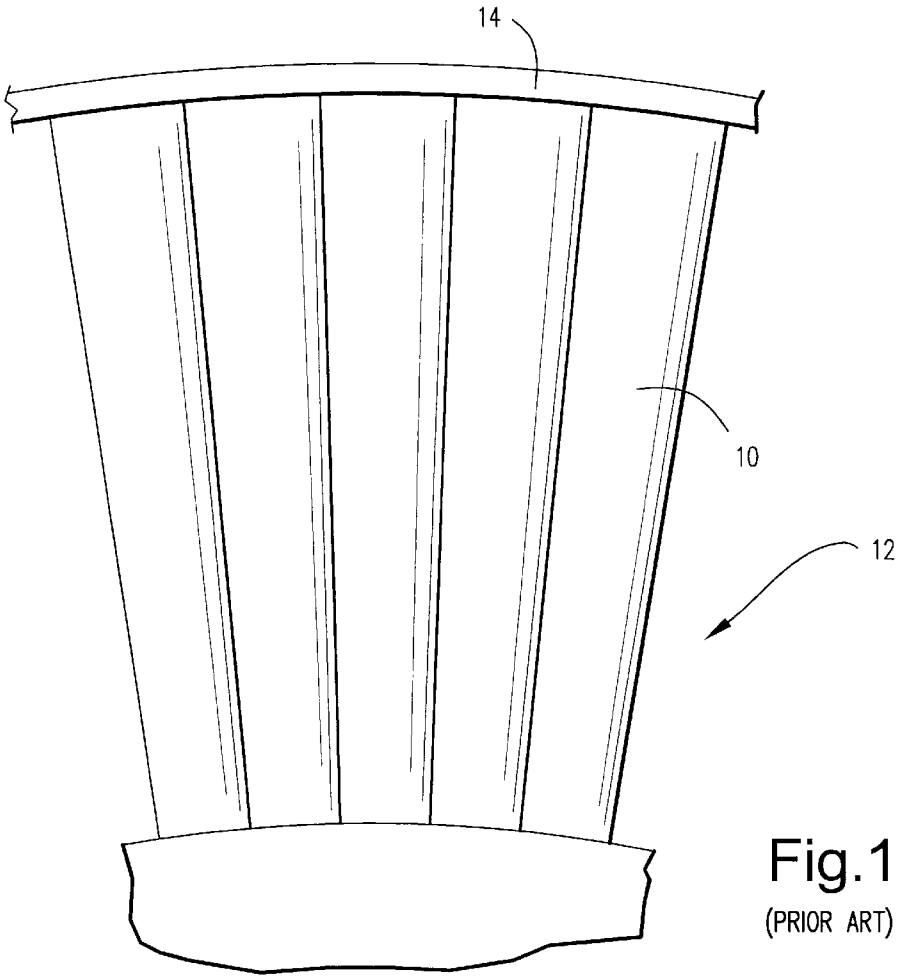
Fig.1 (PRIOR ART)
FIG. 1 is a fragmentary axial view illustrating a plurality of buckets with an attached cover.

Referring now to FIG. 1, there is illustrated a plurality of buckets 10 forming part of a rotating component of a rotor, generally indicated 12, of a steam turbine. Covers 14 are secured to outer tips of the buckets, the covers extending in a circumferential direction. As illustrated in FIGS. 2 and 3, the tips of the buckets 10 have one or more tenons 16 projecting radially outwardly of the tips. Each cover 14 is typically provided in an arcuate circumferentially extending segment for spanning a plurality of buckets, for example, four or five buckets, and has openings 18 for receiving the tenons. The tenons are received in the openings 18 and peened and may be machined to form a flush cover design, as illustrated in FIG. 3.

In the embodiments of the present invention illustrated in FIGS. 4–11, like parts are designated by like reference numerals, preceded by a numeral identifying that embodiment. Accordingly, in FIG. 4, there is illustrated a bucket 110 having a tenon 116 projecting from a tip thereof for engaging in an opening 118 of a cover 114. The outer surface of the cover at the location of the tenon is machined to remove the projecting portion or mushroom of the tenon to provide a flush cover/tenon configuration. Additionally, the leading edge 122 of the cover 114 is provided with a recess 124 formed by a machining process and which recess extends circumferentially the full length of the segment. It will therefore be appreciated that the recess 124 extends circumferentially around the entire periphery of the rotary component, with the recess 124 in each cover 114 forming a continuation of the recesses 124 of adjoining covers 114.

Further, the stationary component 126 is provided with a projecting labyrinth tooth 128 which likewise extends the entire circumferential extent about the cover. The tooth 128 is axially located on the stationary component 126 to project into the recess 124 such that its tip lies radially inwardly of the outer surface 130 of cover 114. Consequently, by utilizing a flush tenon/cover design in combination with a recessed leading edge receiving a labyrinth tooth, the flow coefficient across the gap between the stationary component and the cover is changed, affording a reduced pressure drop, which reduces leakage flow, as well as solid particle erosion.

Figure 5:
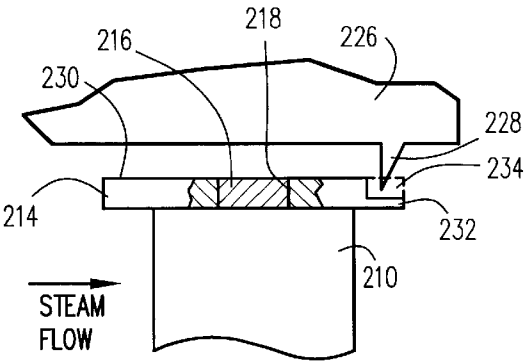
FIGS. 4–11 are fragmentary side elevational views of buckets, tenons, covers, and registering stationary components with parts in cross-section, illustrating various forms of the flush tenon bucket/cover design with advanced sealing according to the present invention.
Figure 4:
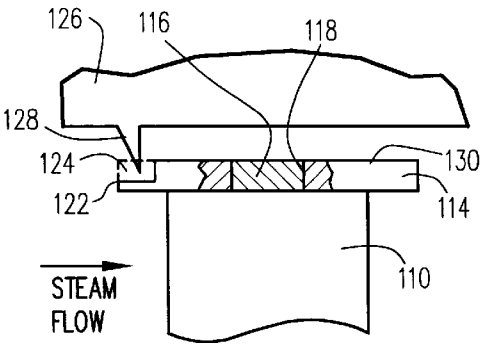

Referring to FIG. 5, the bucket 210, tenon 216, openings 218 and cover 214 are similar to the corresponding bucket, tenon and cover of FIG. 4, except that instead of a leading edge recess 124 as in FIG. 4, the trailing edge 232 of cover 214 is provided with a circumferentially extending recess 234. Also as illustrated, a labyrinth tooth 228 projects radially inwardly from the stationary component 226 into the recess 234 radially inwardly of the outer surface 230 of the cover 214. As in the prior embodiment, the recesses of the covers and the labyrinth tooth extend 360° about the periphery of the rotor and stationary component. Consequently, a significant pressure drop across the gap between the cover and the stationary component occurs, reducing the magnitude of the steam flow and, hence, the capacity for solid particle erosion.

Figure 6:
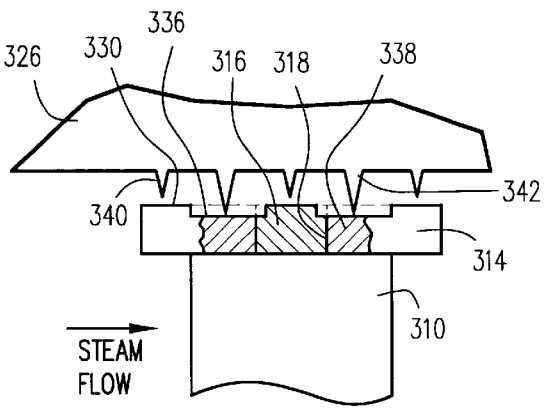

Referring now to FIG. 6, there is illustrated a bucket 310 having a tenon 316 projecting through an opening 318 of a cover 314. The tenon/cover is flush along the outer profiled surface 330 of the cover. In this embodiment, the cover 314 has an increased radial thickness (in comparison with the thicknesses of the covers illustrated in FIGS. 4 and 5) to enable the outer surface of the cover, as well as portions of the tenon, to be machined to form circumferentially extending recesses about the rotary component. As illustrated in FIG. 6, two recesses 336 and 338 are machined into the outer surface of the cover 314 to form the profiled surface 330, the recesses extending the entire circumferential distance about the rotary component. It will be appreciated from a review of FIG. 6 that a portion of the tenon 316 is likewise machined on axially opposite sides of the tenon 316 to form the recesses 336 and 338. The dashed lines in FIG. 6 represent the extent of the cover prior to machining, while the full lines represent the finished cover and tenon with the profiled surface 330. Thus, both the cover portions of the and tenon are machined to form the recesses 336 and 338. Note also that portions of the cover between circumferentially adjacent tenons lie flush with the outer surfaces of the tenons 316.

The stationary component 326 has a plurality of axially spaced labyrinth teeth projecting radially inwardly toward the cover. Teeth 340 have a lesser radial extent than the teeth 342, which project into the recesses 336 and 338, respectively. Note also the intermediate short tooth 340 radially opposite the tenon 316. Consequently, a profile is formed along the outer surface 330 of the cover 314 comprising the recesses 336 and 338, as well as margins of the tenons 316 which have been cut away to form part of the recesses. The combined labyrinth seals and recesses provide increased pressure drop, reduced flow through the gap and, hence, reduce solid particle erosion.

Figure 7:
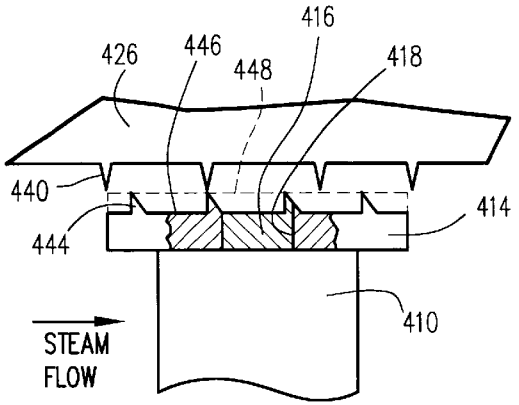

Referring now to FIG. 7, the bucket 410 has one or more tenons 416 projecting through one or more openings 418 in the cover 414 to form a flush cover/tenon design which improved sealing characteristics. In this form, the cover 414 is machined along its outer circumferential face to form a profile having a plurality of axially spaced labyrinth seal teeth 444 defining circumferentially extending recesses 446 between the spaced axial teeth. Note also that the one or more tenons 416 as well as portions of the cover circumferentially adjacent the tenons are machined below the initially provided surface 448 of the cover 414 to form the recess between the immediate pair of teeth 444. The stationary component 426 also includes a plurality of axially spaced, radially inwardly extending labyrinth teeth 440 in radial opposition to the profiled outer surface of the cover 414. The reduced steam flow and pressure drop across the gap between the rotating cover and stationary component thus effectively reduce solid particle erosion.

Figure 8:
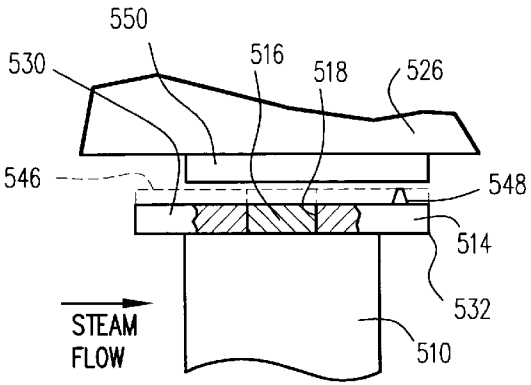

Referring to FIG. 8, there is provided a bucket 510 with a tenon 516 received in a tenon opening 518 in bucket cover 514. As illustrated by the dashed lines 546, the outer surface of cover 514 has been machined to form a profiled surface 530 having a labyrinth tooth 548 projecting radially outwardly and lying adjacent the trailing edge 532 of the cover. As illustrated, the outer surface of the cover 514 including tenon 516 has been machined to provide a profiled surface including a labyrinth tooth 548. Along the stationary component 526, there is provided a radially inwardly and circumferentially extending abradable material 550. It will be appreciated that with this cover design, the reduced flow and pressure drop across the gap between the profiled surface of the cover 514 and abradable material 550 reduce the potential for solid particle erosion. Additionally, because of the abradable material, the gap between the rotary and stationary components can be significantly reduced with any excursions of the rotor beyond design limits abrading the material 550.

Figure 9:
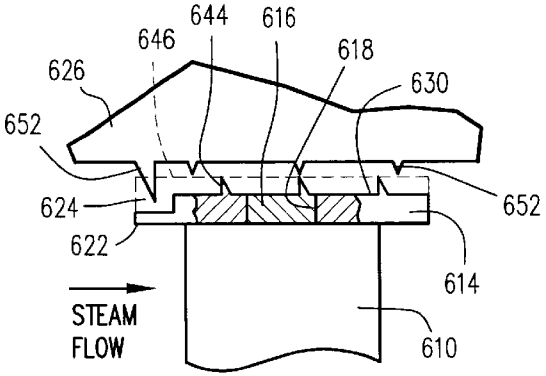

In FIG. 9, the bucket 610 includes one or more tenons 616 received in one or more openings 618, respectively, of the cover 614. In this embodiment, a profile is formed along the outer surface of cover 614 by machining away material, indicated within the dashed line 646, to form a plurality of axially spaced teeth 644 projecting from the flush surface of the tenon and outer cover surface. Note that the intermediate tooth 644 is in part formed by machining the tenon 616 on axially opposite sides thereof. It will be appreciated that the teeth 644 extend continuously in a circumferential direction and that the intermediate tooth is formed of circumferential portions both of the tenon and the original material of the cover 614. Additionally, a recess 624 is formed along the leading edge 622 of the cover 614. The stationary component 626 includes a plurality of axially spaced teeth 650 and 652 extending circumferentially in radial opposition to the profiled surface 630 of the cover 614. The enlarged tooth 652 lies in radial registration with the recess 624, while the radially reduced teeth 652 lie in radial opposition to the remaining portions of the profiled surface 630, including the tenon.

Figure 10:
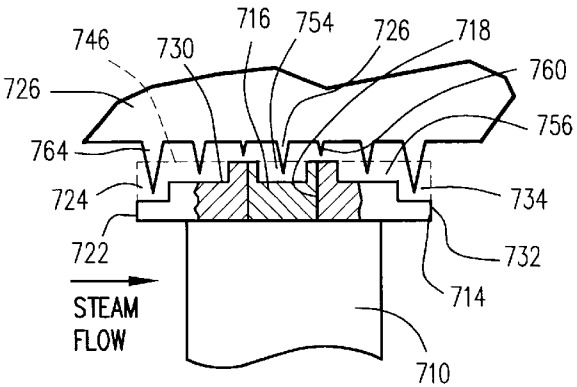

Referring to FIG. 10, the bucket 710 includes one or more tenons 716 extending through one or more openings 718 in the bucket cover 714. As in the prior embodiments, the outer surface 730 of the cover 714 is profiled by machining away material indicated within the dashed lines 746 to form a plurality of recesses extending circumferentially and axially spaced one from the other. For example, a central recess 754 is provided by machining a recess along the outer surface of the cover 714, including passing through the outer surface of the tenon(s) 716. Thus, the recess 754 extends continuously in a circumferential direction and includes portions of the cover and tenons. Additional recesses 756 are formed on opposite sides of the central recess 754. Further, leading and trailing edge recesses 724 and 734 are formed in the outer profile of the leading and trailing edges 722 and 732, respectively.

The stationary component 726 includes a plurality of axially spaced teeth of various sizes, depending upon the nature of the profiled surface 730 of the cover in radial opposition to the teeth. Thus, the short teeth 760 lie in radial opposition to the original outer surface of the cover adjacent the tenon 716, while an intermediate-length, radially inwardly extending tooth 762 projects into the recess 754 formed by the tenons and the outer surface of the cover. Large radially inwardly extending teeth 764 project radially inwardly from the stationary component 726 into the leading and trailing edge recesses 724 and 734, respectively. By providing this tortuous flowpath between the profiled surface 730 of the cover and the stationary component 726, the flow of steam across the gap is significantly reduced, resulting in reduced potential for solid particle erosion.

Figure 11:
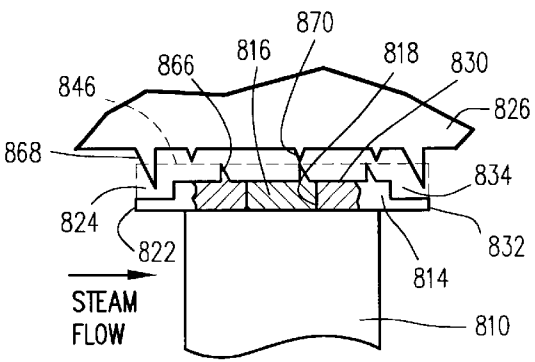

Finally, referring to FIG. 11, the bucket 810 includes one or more tenons 816 projecting through one or more openings 818 of a cover 814. Cover 814 has a profiled outer surface 830. The space within the dashed lines 846 represents material which has been machined away to form the profiled outer surface 830. In this embodiment, it will be appreciated that the outer surface of the cover has been machined to form a plurality of axially spaced radially outwardly projecting teeth 866. Note that the intermediate tooth 816 is formed in part by machining tenon 816, as well as circumferentially adjacent outer portions of the cover. Additionally, the axially opposite ends of the cover 814, i.e., leading and trailing edges 822 and 832, respectively, are provided with recesses 824 and 834. Also, the stationary component 826 includes a plurality of axially spaced large and small teeth 868 and 870. The large teeth 868 project radially inwardly into the recesses 824 and 834 along the respective leading and trailing edges 822 and 832 of the cover 814. The smaller teeth 870 lie in radial registration with the spaces between the teeth 866 or may lie in opposition to the teeth 866.

In all the embodiments above, the flush tenon/cover design is augmented by a profiled surface formed along the cover. The profiled surface includes one or more recesses, one or more teeth, or a combination of recesses and teeth. Additionally, in certain embodiments, the profiled surface is also formed by forming recesses in or teeth from the tenons, or both, so that portions of the machined tenons lie in circumferential flush relation with the recesses or teeth of the adjoining cover surfaces. In this manner, the leakage flow past the gap between the rotary and stationary components is reduced, with resulting reduction in the potential for solid particle erosion.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a steam turbine having a plurality of buckets rotatable about an axis and a stationary component surrounding said buckets, a seal between said buckets and the stationary component, comprising:

a cover mounted on a radial outer end of at least one bucket and having an opening, said one bucket having a tenon projecting from said outer end of said one bucket and extending into said cover opening;

an outer surface of said cover and an outer end surface of said tenon forming a profiled surface in opposition to said stationary component with contiguous surfaces of said tenon end and said cover lying flush with one another, said profiled surface including at least one of a recess formed in said profiled surface and a tooth projecting radially outwardly of said profiled surface.

2. A seal according to claim 1 wherein said profiled surface includes said one recess, said one recess being defined at least in part by said tenon.

3. A seal according to claim 1 wherein said profiled surface includes said one recess, said one recess being defined at least in part by said tenon and circumferentially adjacent portions of said cover surface.

4. A seal according to claim 3 wherein said one recess extends in a circumferential direction.

5. A seal according to claim 1 wherein said profiled surface includes said tooth, said tooth being defined at least in part by said tenon and circumferentially adjacent portions of said cover surface.

6. A seal according to claim 5 wherein said tooth extends in a circumferential direction.

7. A seal according to claim 1 wherein said profiled surface includes said one recess, said one recess being defined at least in part by said tenon and circumferentially adjacent portions of said cover surface, at least one tooth projecting radially inwardly from the stationary component and into said one recess.

8. A seal according to claim 1 wherein said profiled surface includes said tooth, said tooth being defined at least in part by said tenon and circumferentially adjacent portions of said cover surface, at least another tooth projecting radially inwardly from the stationary component.

9. A seal according to claim 8 wherein said one tooth and said another tooth extend in a circumferential direction and lie in radial alignment with one another.

10. A seal according to claim 8 wherein said one tooth and said another tooth are axially spaced one from the other.

11. In a steam turbine having a plurality of buckets rotatable about an axis and a stationary component surrounding said buckets, a seal between said buckets and the stationary component, comprising:

a plurality of covers mounted on radial outer ends of said buckets arranged in an annular array thereof with one or more buckets being secured to each said cover, each cover having at least one opening and each bucket having a tenon projecting from said outer end thereof into said opening;

an outer surface of each said cover and an outer end face of each said tenon forming a profiled surface in opposition to said stationary component with contiguous surfaces of said tenon end faces and said outer cover surface lying flush with one another, said profiled surface including at least one recess formed therein.

12. A seal according to claim 11 wherein said one recess is defined at least in part by said tenon.

13. A seal according to claim 11 wherein said one recess is defined at least in part by said tenon and at least in part by said cover surface.

14. A seal according to claim 11 wherein said one recess extends in a circumferential direction.

15. In a steam turbine having a plurality of buckets rotatable about an axis and a stationary component surrounding said buckets, a seal between said buckets and the stationary component, comprising:

a plurality of covers mounted on radial outer ends of said buckets arranged in an annular array thereof with one or more buckets being secured to each said cover, each cover having at least one opening and each bucket having a tenon projecting from said outer end thereof into said opening;

an outer surface of each said cover and an outer end face of each said tenon forming a profiled surface in opposition to said stationary component with contiguous surfaces of said tenon end faces and said outer cover surface lying flush with one another, said profiled surface including at least one recess;

said profiled surface including a tooth projecting radially outwardly thereof.

16. A seal according to claim 15 wherein said tooth is defined at least in part by said tenon.

17. A seal according to claim 15 wherein said tooth is defined at least in part by said tenon and at least in part by said cover surface.

* * * * *

UNITED STATES PATENT AND TRADEMARK OFFICE

CERTIFICATE OF CORRECTION

PATENT NO. : 6,679,681 B2
DATED : January 20, 2004
INVENTOR(S) : Burnett et al.

It is certified that error appears in the above-identified patent and that said Letters Patent is hereby corrected as shown below:

Column 6,
Line 30, delete "said profiled surface." and insert --said profiled surface, said one of the recess and tooth being defined at least in part by said tenon. --.

Column 7,
Line 10, delete "formed therein." and insert -- formed therein and defined at least in part by said tenon. --.
Line 11, cancel claim 12.
Line 15, delete "at least in part by said tenon and".

Column 8,
Lines 13-14, delete "radially outwardly thereof" and insert -- radially outwardly thereof and at least in part by said tenon. --.
Line 15, cancel claim 16.
Line 18, delete "at least in part by said tenon and".

Signed and Sealed this

Twenty-seventh Day of July, 2004

JON W. DUDAS
*Acting Director of the United States Patent and Trademark Office*